United States Patent [19]

Peterson

[11] 3,990,122

[45] Nov. 9, 1976

[54] PATIENT LIFT

[75] Inventor: Frank C. Peterson, West Long Branch, N.J.

[73] Assignee: Lawrence Peska Associates, Inc., New York, N.Y. ; a part interest

[22] Filed: Dec. 3, 1975

[21] Appl. No.: 637,271

[52] U.S. Cl. ..... 5/327 R; 5/92; 297/431

[51] Int. Cl.[2] ..... A47C 7/50; A61G 7/08

[58] Field of Search ..... 5/327 R, 327 B, 92, 5/81 R; 297/429, 430, 431

[56] References Cited

UNITED STATES PATENTS

| | | | |
|---|---|---|---|
| 2,608,239 | 8/1952 | Gorden | 297/330 X |
| 2,952,855 | 9/1960 | Zuti | 5/92 X |
| 3,437,303 | 4/1969 | Pickles | 297/330 X |
| 3,729,751 | 5/1973 | Kirkman | 5/66 |
| 3,871,036 | 3/1975 | Attenburrow | 5/81 R |

*Primary Examiner*—Casmir A. Nunberg
*Assistant Examiner*—Andrew M. Calvert

[57] ABSTRACT

An adjustable footboard is disclosed in combination with a bed such as a hospital bed for allowing the occupant of the bed to move themselves in the direction of the head of the bed. The apparatus is especially useful in hospital beds, the matteress of which if foldable at several points along its longitudinal edge in order to provide extra or additional comfort to the occupant. When the mattress is folded to elevate the back of the patient in the bed, the patient's weight is shifted towards the foot of the bed which after a time, can be a source of discomfort to the patient but can be relieved by providing the adjustable footboard that is automatically brought into contact with the patient's feet to allow the patient to reposition themselves.

5 Claims, 2 Drawing Figures

PATIENT LIFT

SUMMARY OF THE INVENTION

The present invention relates to an adjustable footboard for a bed comprising a bed having a headboard at one end and a footboard at the opposite end. An opening is provided in the footboard for receiving the mattress of the bed. Guide bars are provided, the longitudinal axis of which is substantially parallel to the longitudinal edge of the mattress in the region of the footboard. Guide members are provided in the footboard for slidingly engaging the guide bar and for guiding the footboard along the length of the mattress. An engine such as an electric motor is operatively connected to the footboard for moving the footboard along the guide bars. A switch operable from the mattress for switching the engine on and off is positioned to be within easy reach of a patient or an occupant of the bed, the switch being connected to the engine or electric motor to turn the engine on and off and for reversing the direction of travel of the footboard. In one embodiment the engine comprises an electric motor which is rotatingly connected to a threaded shaft that extends in the longitudinal direction of the mattress for screwingly engaging the footboard, threaded shaft receiving means being provided in the footboard for receiving said shaft so that when the shaft is turned the footboard is moved in a direction towards or away from the headboard.

The guide bars have slots extending in a direction parallel to the longitudinal edge of the mattress, guide members projecting from the footboard into the slots of the guide bars so that when the footboard is moved towards or away from the head of the bed, it will travel in a direction substantially parallel to the longitudinal edge of the mattress. The footboard is especially suitable for use in a hospital bed having a mattress which is foldable along its longitudinal edge to provide greater comfort for the patient in the bed. When the back of the patient is raised their weight is shifted towards the foot of the bed which would cause them to slide in that direction. The adjustable footboard of the present invention allows the patient to move towards the direction of the head of the bed by moving the adjustable footboard into position against their feet and further permitting them to shift their weight towards the direction of the head of the bed by bracing themselves with their legs against the adjustable footboard.

DETAILED DESCRIPTION OF THE SEVERAL VIEWS OF THE DRAWING

DETAILED DESCRIPTION

Adjustable hospital beds are known in the prior art as illustrated in U.S. Pat. Nos. 3,871,036 Attenburrow; 3,729,751 Kirkman; 3,418,670 Morgan; 3,324,484 Benoit; 3,302,219 Harris; 3,175,229 Bergenwall and 2,438,093 Miller.

Patients confined to hospital beds of the type described in the foregoing prior art continually slide to the foot of the bed when the bed is adjusted so that the back of the patient is elevated. Patients who are immobilized by a disease or disorder are unable to move sufficiently in such beds to reposition themselves and generally require a nurse to assist them to move toward the head of the bed so that they are more comfortable. This is extremely difficult on a patient having heart problems or sutures in the torso area. It also uses nurses' time that might be spent in other patient care. Since most hospital patients don't have problems with their legs and would be able to push themselves up in bed it would be advantageous to provide means to this end. U.S. Pat. No. 3,729,751 Kirkman discloses a movable footboard on an adjustable hospital bed, however does not obviate the aforementioned difficulties since as the position of the bed is changed the needs of the patient to realign himself towards the head of the bed also change and the Kirkman device cannot be moved automatically and individually controlled by the patient as the angle of adjustment of the mattress is changed to provide greater patient comfort.

It is therefore an object of the present invention to overcome these and other difficulties encountered in the prior art. It is a further object of the present invention to provide an adjustable footboard which may be automatically aligned with the feet of the patient to allow the patient in a hospital bed to move themselves towards the direction of a headboard without requiring the assistance of a nurse or other hospital attendant to adjust the footboard or to assist the patient in positioning themselves towards the headboard of the hospital bed.

These and other objects have been achieved by the present invention and will become apparent from the disclosure and claims that follow as well as the appended drawing.

Figure 1:
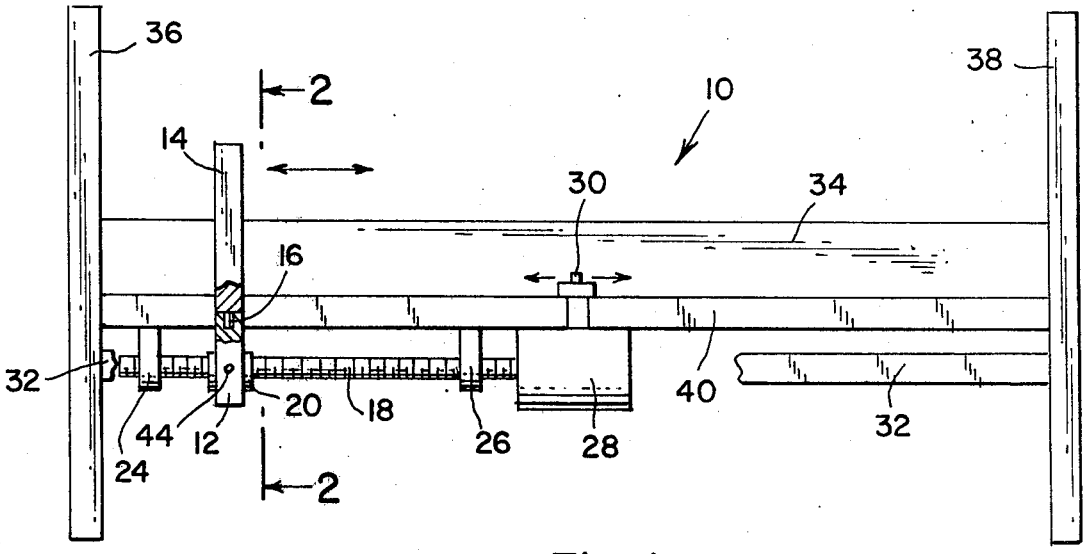
FIG. 1 is a side elevation in section illustrating a bed having an adjustable footboard according to one embodiment of the present invention.
Figure 2:
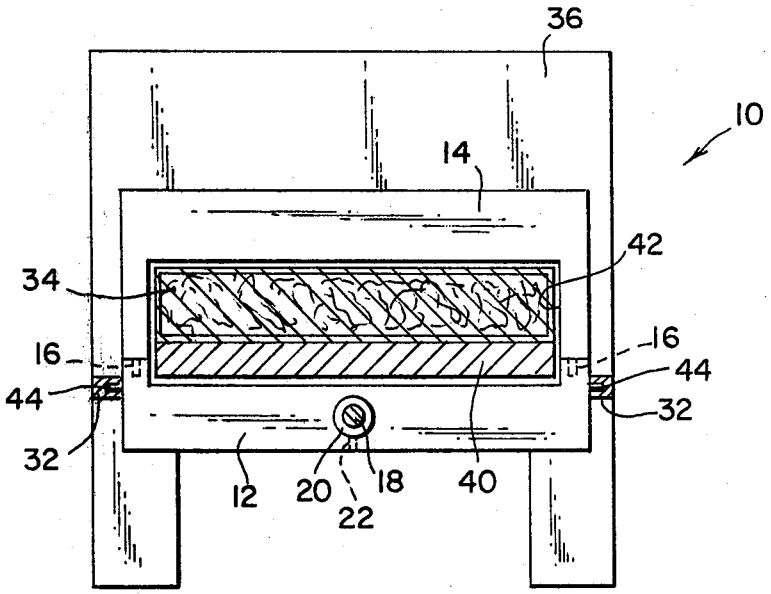
FIG. 2 is a front elevation in section taken along the line 2—2 of FIG. 1.

Referring to the drawings and FIGS. 1 and 2, an adjustable footboard in combination with a bed 10 comprising a headboard member at one end and a footboard at the opposite end is illustrated. A lower half of adjustable footboard 12 and an upper half of an adjustable footboard 14 fit together and are held by means pins 16, an opening 42 being provided between the upper half 14 and the lower half 12 for sliding over a mattress 34. The footboard comprising sections 12 and 14 when joined are moved together as a unit to slide over mattress 34 at the footboard end of the bed in a direction substantially parallel to the vertical edge of the mattress 34. Footboard 12 and 14 are moved in this manner by means of a threaded shaft 18 which screwingly engages the lower portion 12 of the footboard through threaded journal 20 held in place by means of pin 22. Threaded shaft 18 is supported from underneath the frame 40 by means of brackets 24 and 26, frame 40 being supported by headboard 38 and legs 36. Threaded shaft 18 is rotated by means of an engine such as electric motor 28 which is turned on or off or in a forward or reverse direction by means of switch 30 positioned next to mattress 34 so that a patient or occupant of the bed 10 may be able to control the movement of the footboard towards or away from the headboard 38 by turning shaft 18 through motor 28. Guide rails 32 having slots therein for slidingly receiving pins 44 which project outwardly from lower section 12 of the footboard guide the footboard in a direction parallel to the vertical edge of mattress 34 which is adjusted by folding the frame 40 in a manner known in the adjustable hospital bed art.

In use, a patient is positioned in bed 10 and the mattress raised at the headboard 38 in a known manner. The occupant or patient in bed 10 may adjust the footboard comprising upper section 14 and lower section 12 by moving the footboard towards or away from the headboard 38. The patient may then brace themselves against the upper section of footboard 14 to prevent sliding in the direction away from the headboard and may also be able to move themselves towards the direction of headboard 38 to avoid discomfort, a nurse or hospital attendant not being required to aid the patient in making these adjustments for attaining maximum body comfort. As the section of the mattress 34 near the headboard 38 is lowered, the footboard may be moved away from or toward headboard 38 by means of the switch 30 which turns electric motor on or off or in a forward or in a reversing direction.

Although the invention has been described by reference to some embodiments, it is not intended that the novel adjustable footboard and hospital bed in combination therewith be limited thereby but that modifications thereof are intended to be included as falling within the broad scope and spirit of the foregoing disclosure, the following claims and the appended drawing.

What is claimed is:

1. An adjustable footboard for a bed comprising bed means having headboard means at one end and footboard means at the opposite end of said bed, opening means in said footboard for receiving mattress means, guide bar means, the longitudinal axis of which is substantially parallel to the longitudinal edge of said mattress at the end of said mattress in the region of said footboard, guide means in said footboard for slidingly engaging said guide bar and for guiding said footboard along the length of said mattress, engine means operatively connected to said footboard for moving said footboard along said guide rails, switch means operable from said mattress for switching said engine on and off and for reversing the direction of travel of said footboard.

2. The adjustable footboard of claim 1 where said engine comprises an electric motor rotatingly connected to threaded shaft means extending from said motor in the longitudinal direction of said mattress, said shaft means screwingly engaging threaded shaft receiving means secured to said footboard.

3. The adjustable footboard of claim 2 where said guide bar is co-extensive with side rail support means of said bed, said side rails supporting said mattress, said guide bars having slots extending in the longitudinal direction of said mattress, guide means projecting from said footboard for guiding said footboard in a longitudinal direction parallel to said mattress.

4. The footboard of claim 3 where said bed means comprises a hospital bed having a mattress which is adjustably folded along its longitudinal edge to provide comfort for the bed occupant in a non-horizontal reclinging position whereby said footboard may be employed by the occupant of said bed to shift body weight in the direction of said headboard.

5. The adjustable footboard of claim 4 where said footboard is separable into an upper half and a lower half through securing means for removably securing said upper half of said footboard to said lower half of said footboard.

* * * * *